US005893242A

United States Patent [19]

Perron

[11] Patent Number: 5,893,242

[45] Date of Patent: Apr. 13, 1999

[54] THERMALLY INSULATING EXTERNAL WINDOW SHUTTER

[76] Inventor: Jocelyn Perron, Quebec, Canada

[21] Appl. No.: 08/979,361

[22] Filed: Nov. 26, 1997

[51] Int. Cl.[6] ..... E06B 3/26; E05F 11/00

[52] U.S. Cl. ..... 52/202; 49/362; 49/360

[58] Field of Search ..... 52/202; 49/362, 49/360, 425, 61, 63

[56] References Cited

U.S. PATENT DOCUMENTS

| | | | |
|---|---|---|---|
| 1,279 | 8/1839 | Grenville et al. | 49/360 |
| 32,512 | 6/1861 | Douglass | 49/362 |
| 226,320 | 4/1880 | Jewell | 49/362 |
| 1,801,115 | 4/1931 | Semish . | |
| 2,301,568 | 11/1942 | Moss . | |
| 2,611,936 | 9/1952 | Wheeler . | |
| 2,808,626 | 10/1957 | Sassano | 49/362 |
| 3,452,477 | 7/1969 | Sassano | 49/362 |
| 4,242,836 | 1/1981 | Anderson . | |
| 4,267,666 | 5/1981 | Davidson | 49/63 |
| 4,457,106 | 7/1984 | Forquer . | |

*Primary Examiner*—Carl D. Friedman
*Assistant Examiner*—Dennis L. Dorsey

[57] ABSTRACT

A shutter assembly for installation on the outside of a building wall including one or two shutter panels fitted with top and bottom rollers moveable along tracks in a plane outwardly spaced from and parallel to the external wall. A rack is carried by each panel inside thereof and a pinion, meshing with this rack, is carried by a shaft extending through the wall and provided at its inner end, inside a building room with a crank wheel for moving the shutter panels between opened and closed position at the side and in front of a window opening respectively. The shutter panels are heat-insulated and are provided with seals to extend around the periphery of the window opening when the panels are in closed position to thereby form an air insulating chamber with a window unit within the window opening. The top rollers together with the rack are fitted with a spring suspension to permit easy installation and removal of the rollers on and from the tracks and to accommodate any variation in the vertical position of the pinion which may have occurred during the installation.

5 Claims, 4 Drawing Sheets

6
116
50
46
2
3
44
48
52
60
54
58
42
40
38
36
12
132
32
128
8
28
16
130
30
34
144
26
14
136
10
18
134
82
124
74
120
4
114
102
104
86
78
125
84
106
108
110
112
122
20
79
120
80
118
22
126
24
76
62
68
70
64
3
66
72

THERMALLY INSULATING EXTERNAL WINDOW SHUTTER

FIELD OF THE INVENTION

The present invention relates to a window shutter unit.

BACKGROUND OF THE INVENTION

Window shutter units for installation on the outside of a building are known such as in U.S. Pat. No. 2,301,568 dated Nov. 10, 1942, inventor F. J. Moss entitled WINDOW SHUTTER.

In this patent the shutter panels are moved along tracks between an opened position at the side of a window and closed position in front of the window and are manipulated by means of cables extending through the building wall to be accessible inside the building. The window shutter of this patent is not designed to be used in cold weather since the bore made through the building wall to accommodate the actuating cables cannot be properly sealed against cold air entrance. Also, in this patent, the shutter panels are not heat insulating and no seals are provided to surround the window opening and contact the closed shutter panels in order to form a heat insulating air chamber in front of the window.

U.S. Pat. No. 4,267,666 dated May 19, 1981 entitled SHIELD FOR A WINDOW, inventor James D. Davidson, describes shutters which are slideable within the building wall in an interior space of the latter to take an opened position. It follows that the shutters, when in the latter position, cannot be used as decorative items for the window since they are hidden from view. However, the shutter panels are made of heat insulating panels and they are sealed against the outside weather when in closed position.

OBJECTS OF THE INVENTION

The main object of the present invention is to provide a shutter unit which obviates the above-noted disadvantages.

Another object of the present invention is to provide an outside shutter unit in which the shutter panels, when in opened position unmasking the window, constitute an ornamentation for this window and yet, when in closed position, masking the window, forms an air chamber which insulates the window against the cold outside weather.

Another object of the present invention is to provide a window unit of the character described in which the shutter panels are moved between opened and closed position by a simple crank wheel and rack and pinion mechanism, the crank wheel being readily accessible inside the building.

Another object of the present invention is to provide a shutter unit of the character described which is simple and of inexpensive construction and the shutter panels of which are easily installed on and removed from the supporting and guiding tracks.

SUMMARY OF THE INVENTION

The shutter unit of the present invention is for installation on the outside of an external building wall having an inside and an outside face and a window opening and comprises a top track and a bottom track, means to secure the tracks to the building wall in horizontal positions above and below the window opening respectively and outwardly spaced from the wall outside face, a shutter panel having an outside and an inside face, top and bottom guiding roller means carried by the panel at the panel inside face and engageable with the top and bottom side respectively of the top and bottom tracks to support the panel in a vertical plane outwardly spaced from and parallel to the building wall outside face and guide the panel for movement in the plane between opened and closed positions at a side of the window opening and in front thereof respectively, a horizontal rack carried by the panel and inwardly spaced from the panel inside face, a driving shaft of a length to extend through a bore made in the external building wall and protrude from the building wall inside and outside faces, a manually operable crank wheel and a rack meshing pinion to be secured to opposite ends of the driving shaft at the wall inside and outside faces respectively for moving the panel between closed and opened positions, the shutter panel of a size to extend above and below the window opening and conceal the tracks, thermal insulating means carried by the shutter panel, protruding from its inside face and of a size and in a position to register with the window opening in the closed position of the shutter panel, and seal means carried by the panel at its inside face and engageable with the building external wall at its outside face to seal the periphery of the window opening when the panel is in the closed position and to allow movement of the panel from the closed to the opened position.

Preferably, the shutter unit further includes a first spring suspension means interposed between the panel and the top guiding roller means to upwardly bias the panel against the weight thereof and maintain the bottom guiding roller in rolling and guiding engagement with the bottom side of the bottom track while allowing retrieval of the bottom guide roller means from the bottom track upon downwardly pressing the panel against the bias of the first spring suspension means and a second spring suspension means interposed between the panel and the rack to bias the rack in meshing engagement with the pinion.

Preferably the shutter unit also further includes first shield means adapted to be secured to the building wall outside face and spacedly extend over and outwardly of the panel in both positions of the latter, second shield means carried by the panel and surrounding the rack and pinion and having an elongated gap for the passage of the driving shaft and prevent the shaft from interfering with the panel movement between the open and closed position, and third shield means carried by the bottom track and spacedly extending over the bottom guiding roller means.

Preferably, the shutter panel has a rectangular shape and a size such that top and bottom and side marginal portions thereof will protrude from the lintel, sill and jambs of the window opening and wherein the seal means include a lower horizontal sealing brush strip carried by the panel at its inside face at a level to slide on the window opening sill, an upper horizontal sealing brush strip adapted to be secured to the external wall above the window opening, a horizontal strip carried by the panel at its inside face at a level and positioned for sliding engagement with the upper brush strip, a vertical sealing brush strip carried by the panel at its inside face and a vertical abutment member adapted to be fixed to the building wall at a level to sealingly engage the vertical brush strip when the panel is in closed position and further including seal means surrounding the driving shaft.

Preferably, the unit further includes crank wheel locking means to lock the crank wheel in any adjusted rotated position and to thereby lock the panel in horizontally adjusted position on the tracks.

The present invention is also directed to the combination of a shutter unit with an external wall of a building structure having a window opening which is fitted with a window unit, the external wall having an outside and an inside face and a window opening sill protruding from the outside face, the shutter unit having top and bottom, horizontal track means secured to the external wall on the outside thereof with the top track means located above the window opening and the bottom track means located below the sill, a shutter panel supported by the top track means and guided by both the top and bottom track means for movement in a plane parallel to and outwardly spaced from the building wall outside face and outwardly of the sill between an open and a closed position in front of the building wall at a side of the window opening and in front of the window opening respectively, driving means for moving the panel from one to the other of the positions, manually operable means located at the inside face of the building wall and accessible in a room of the building structure, adjacent the window opening extending through the building wall and connected to the driving means to actuate the latter, thermal insulation carried by the panel at its inside face in a position to register with the window opening when the panel is in closed position, and seal means to seal the periphery of the window opening between the panel and the external wall when the panel is in closed position.

Preferably, the driving means of the above combination include a rack carried by the panel between the latter and the building wall, parallel to the tracks and below the sill and a pinion meshing with the rack, the manually operable means including a shaft extending through a bore of the building external wall, a crank wheel secured to one end of the shaft at the inside face, the pinion secured to the opposite end of the shaft externally of the outside face and seal means surrounding the drive shaft.

Preferably, the seal means include sealing brushes carried by the panel and in sliding contact with engagement members carried by the external wall.

Preferably, the combination further includes a crank wheel locking means to lock the crank wheel in any adjusted rotated position.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
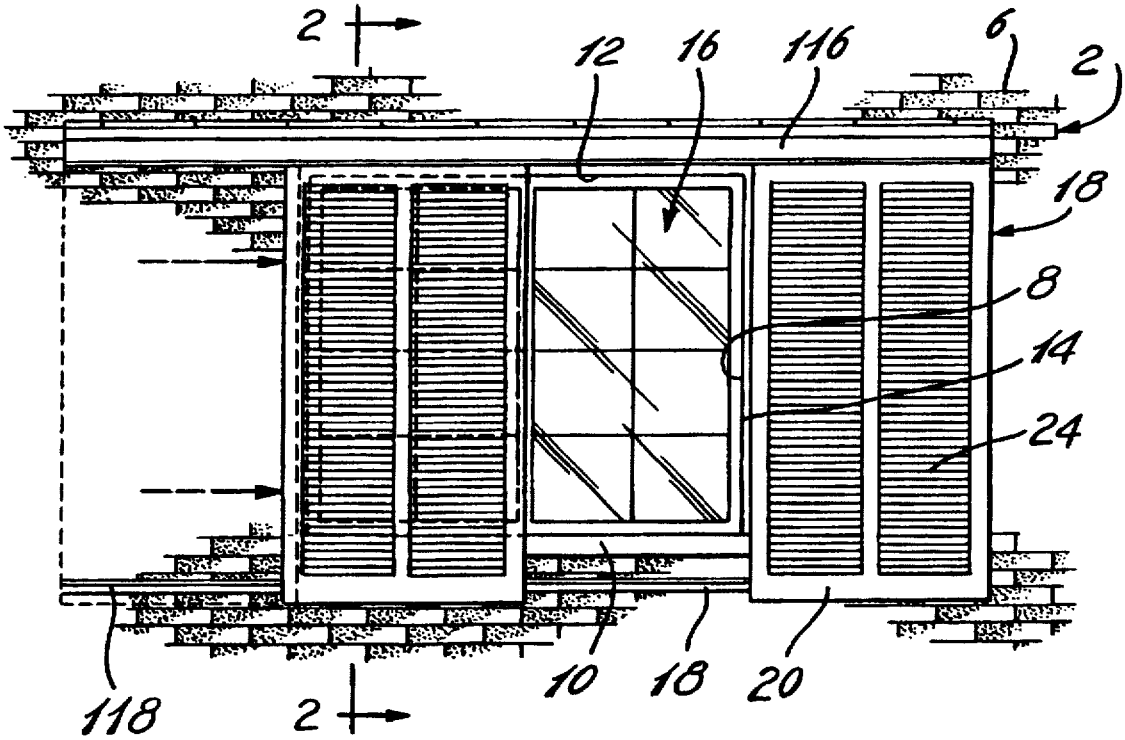
FIG. 1 is a front elevation of the shutter unit of the invention mounted externally of a partially shown building wall with the left hand shutter panel being in window closing position and the right hand shutter panel being in opened position.
Figure 2:
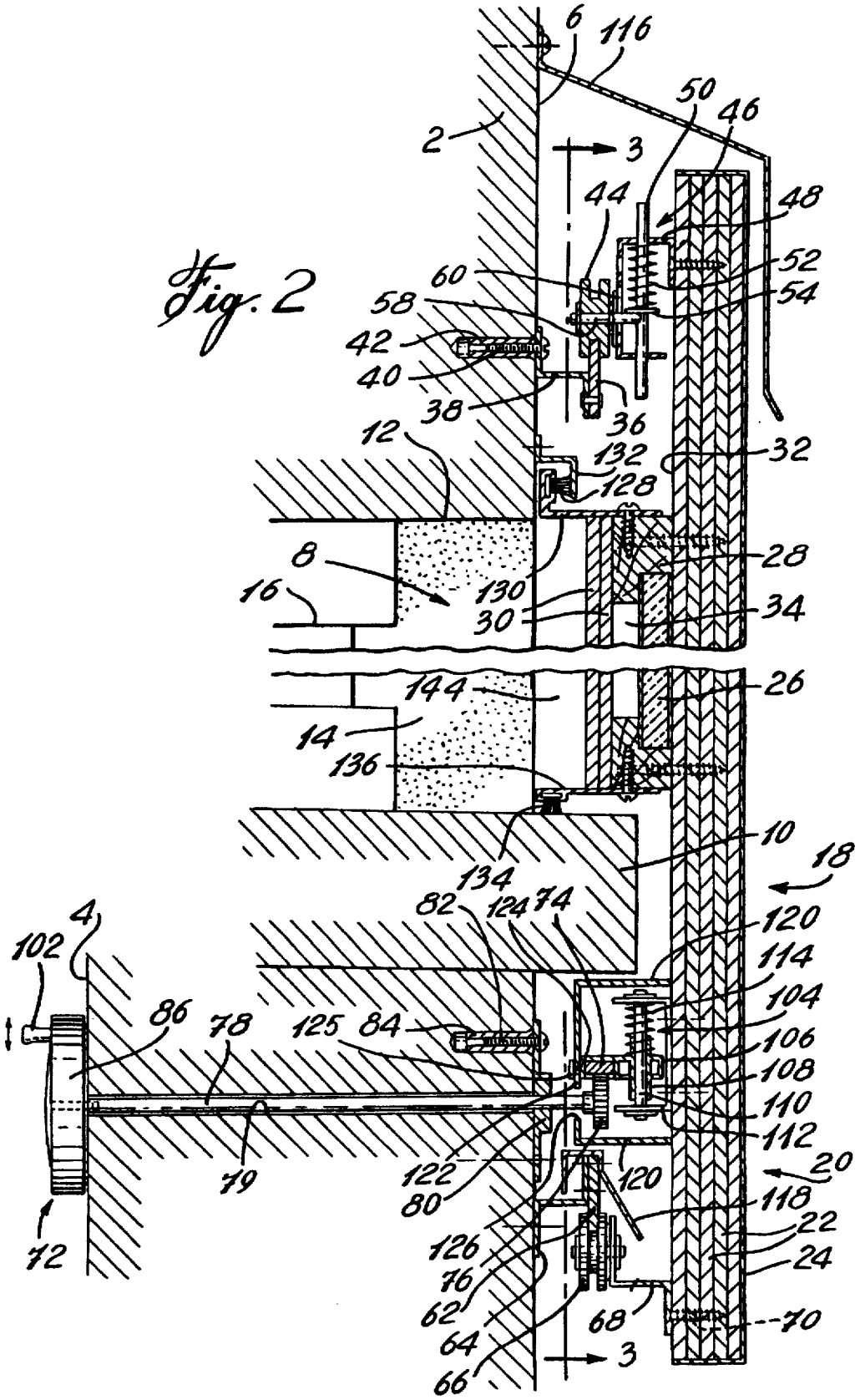
FIG. 2 is a partial cross-section taken along line 2—2 of FIG. 1.

Referring to FIGS. 1 and 2, there is shown an external building wall 2 defining an inside face 4 and an outside face 6, the latter being constituted, for instance, by a brick facing.

In the building wall, there is formed a window opening 8 defining a sill 10, a lintel 12 and jambs 14. A window unit 16 is inserted within the window opening 8 and is of any standard construction.

Window opening 8 is provided with a shutter unit 18 in accordance with the present invention. This unit comprises a pair of panels 20, each made of plywood sheets 22 covered by a metal sheathing defining the outside face of the panel 20. This sheathing can be shaped to form decorative slats as shown in FIG. 1.

A thermal insulation 26 preferably reflective to infrared irradiation is applied against the centre part of the inner sheet 22 and is retained and surrounded by a frame 28 which is approximately the same size as window opening 8.

Frame 28 inwardly protrudes from the insulation 26 and two or more plywood sheets 30 are secured to frame 28, are the same size as the latter and form an air chamber 34 with the frame 28 and the insulation 26.

A top track 36 is secured to the outside building wall 2 by means of horizontally spaced brackets 38 which are secured to the building wall by screws 40 and anchors 42.

Track 36 is horizontally disposed and preferably consists of a flat rectilinear metal strip on which rides top rollers 44 provided with a peripheral groove to receive the track and to be guided thereon. Each top roller 44 is fitted with a spring suspension 46 which comprises a box-shaped bracket 48 secured to the inside face of panel 20, more particularly to the inside plywood sheet 22. A vertical pin 50 is guided for axial movement through holes of bracket 48 and a compression spring 52 surrounds pin 50 and rests on a collar 54 secured to the pin, the top portion of the spring engaging under the top flange of the bracket 48 whereby the weight of the panel 20 is supported by the rollers 44 through the intermediate action of the coil spring 52.

A side axle 58 is secured to pin 50 under the collar 54 and extends through a vertical guiding slit 60 made in the vertical section of the box-shaped bracket 48. The roller 44 is retained on axle 58 against axial movement.

A bottom track 62 is also secured to the external face of the building wall by means of horizontally spaced bottom brackets 64.

The two tracks 36 and 62 are parallel to each other, are outwardly spaced from the outside face of the building wall and are disposed in a common vertical plane parallel to the building wall 2.

A plurality of bottom rollers 66 are secured to the inside of the panels 20 by means of brackets 68 and are also peripherally grooved to retain the bottom edge of the strip-like bottom track 62.

Bottom guiding rollers 66 are not provided with a spring suspension, their brackets 68 are secured to the panels 20 by screws 70.

The two tracks 36 and 62 are respectively located above the window opening lintel 12 and below the sill 10 which outwardly projects from the outside face 6 of building wall 2.

The two shutter panels 20 are horizontally moveable in a plane parallel to the building wall 2 by means of a driving mechanism generally indicated at 72. This mechanism serves to move the two panels between an opened position as shown at the right hand side of FIG. 1 wherein the panel is on the outside of the window opening 8 and window 16 and a closed position as shown at the left hand side of FIG. 1 in which the panel 20 is in front of the window opening and associated window unit 16.

Figure 3:
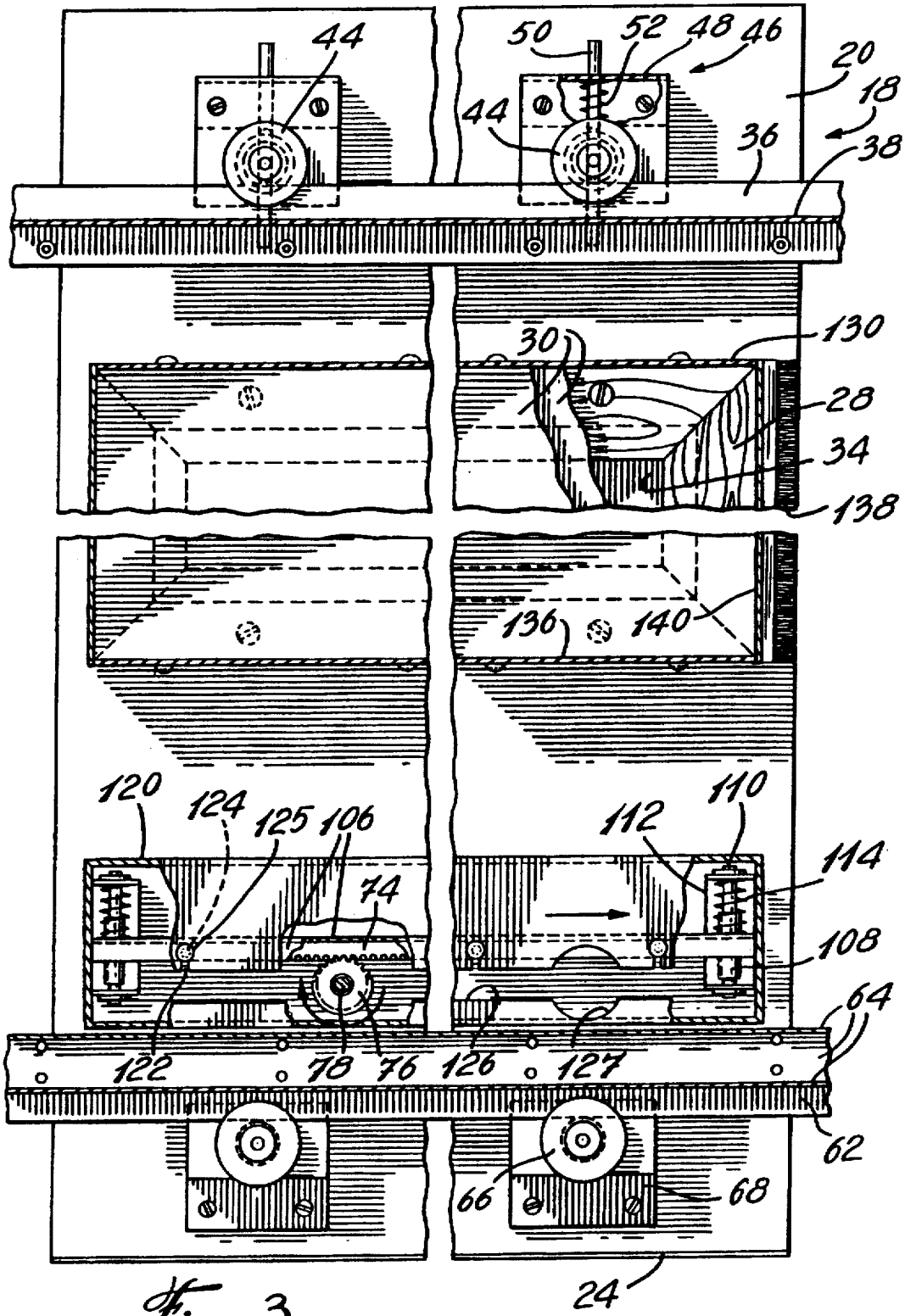
FIG. 3 is a partial elevation taken along line 3—3 of FIG. 2.

Driving mechanism 72 is clearly shown in FIGS. 2 and 3. It includes a rack 74 which is rigid and with which meshes a pinion 76 secured to the outer end of a driving shaft 78 which extends through a building wall through bore 79 and which is journalled and sealed in an external journal disc 80 which is fixed to the outside face of the building wall 2 by means of screws 82 and anchors 84.

Figure 5:
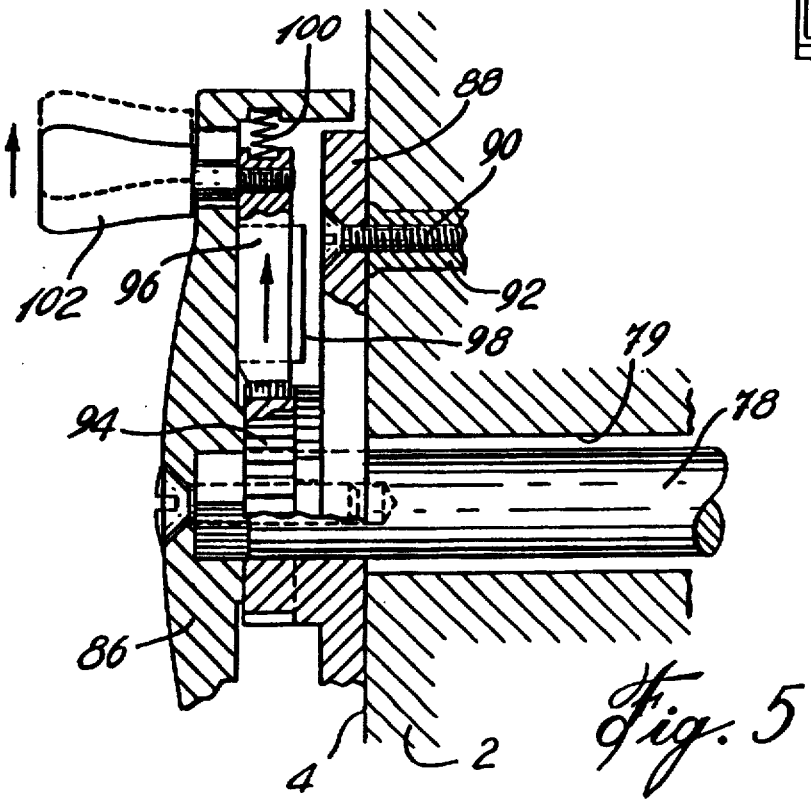
FIG. 5 is an enlarged section of the building wall and of the crank wheel.

As shown in FIG. 5, a crank wheel 86 is secured to the inner end of driving shaft 78, this inner end being journalled and sealed in a journal disc 88 fixed to the inside face 4 of the building wall 2 by means of screws 90 and screw anchors 92.

A gear 94 protrudes from and is integral with disc 88 being co-axial with shaft 78. A dog 96 is located between two radial guides 98 which are fixed to the inside of crank wheel 86. Dog 96 is radially inwardly biased against gear 94 by a compression spring 100. The crank wheel is rotated by a handle 102, the shaft of which is fixed to the outer end of the dog 96. This constitutes a locking mechanism to positively lock the shutter panel 20 in any adjusted position along its guiding tracks.

The handle 102 is radially outwardly biased by the operator's hand to rotate shaft 78. When handle 102 is released, dog 96 engages a gear tooth of gear 94 under the action of spring 100.

Referring to FIGS. 2 and 3, rack 74 is fitted with a spring suspension 104. More particularly, rack 74 is partially enclosed in a box-shaped rack support 106 which is fitted at spaced intervals with vertical guiding sleeves 108, each of which surrounds a vertical guide pin 110 supported by a bracket 112 secured to the inside face of the inner sheet 22 of panel 20. A compression coil spring 114 surrounds each guide pin 110 and the top portion of sleeve 108. Spring 114 abuts against the top of rack support 106 and against the underside of the top flange of bracket 112. The spring suspension 104 ensures proper meshing engagement of the pinion 76 with the rack 74 despite the fact that through bore 79 made through the building wall 22 for insertion of driving shaft 78 may lack precision as to its vertical position.

In order to protect the track and roller arrangements against snow, rain and ice, there is provided a top shield 116 in the form of an inclined metal sheet which is secured to the building wall at its external surface above the top edge of the panels 20 and outwardly of the outside face of the panels as shown in FIG. 2. Top shield 116 extends horizontally the entire length of the shutter unit 18 in the opened position of the two shutter panels 20 as shown in FIG. 1.

Similarly, the bottom track 62 is fitted with a bottom shield 118 secured to the track and brackets 64 and outwardly downwardly inclined to protect guide rollers 66. Bottom shield 118 also extends the full length taken by the two panels 20 in their opened position as shown in FIG. 1.

The rack and pinion mechanism is also protected against the weather elements by a shield 120 fixed to the rack support 106 via a plurality of short vertical slots 122. The vertical slots 122 slide onto pins 124 located on the edge of the rack support 106 and retaining the shield 120 with their heads 125. The shield 120 is partially opened with a horizontal slot 126 for the passage of driving shaft 78 during the horizontal movement of the shutter panels and this shield also serves during installation and removal of the shutter panels from engagement with the top track 36 and bottom track 62. At one location, the horizontal slot 126 is enlarged to form a circular hole 127 for the passage of the pinion 76 during installation and removal of the shutter panels.

Installation of the shutter panels is easy: the top rollers 44 are dropped onto the top rail 35 and the shutter panels 20 are pressed down against the action of the compression springs 52 so as to lower the panels enough for guide rollers 66 to clear the bottom edge of the bottom track 62. Upon release of the downward pressure on the panels, the bottom rollers are caused to engage the underside of the track 64.

Rack 74 is engaged with pinion 76 during the initial installation of the rollers 44 on the top track 36. Spring suspension 104 for the rack 74 allows the downward movement of the panel as above described to permit engagement of the bottom rollers 66 with the underside of bottom rack 62.

The shutter unit is also provided with an upper sealing brush strip 128 which is horizontally secured to the shutter frame 28 by means of a bracket 130. The brush strip 128 is in sliding contact with a horizontal Z-shaped metal strip 132 which is secured to the building wall 2 along the window opening lintel 12.

A horizontal lower sealing brush strip 134 is secured to a support 136 which is secured to the underside of frame 28. Sealing brush 134 is in sliding contact with the top of the window opening sill 10 as clearly shown in FIG. 2.

Figure 4:
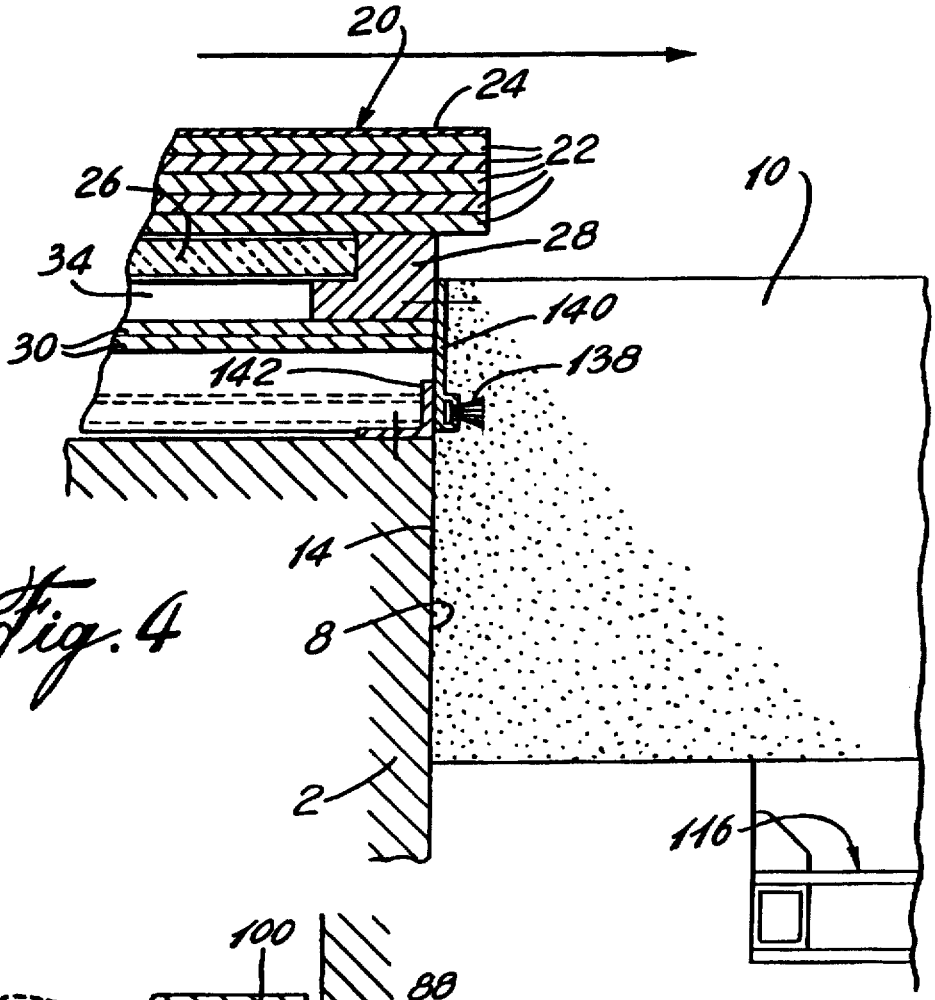
FIG. 4 is a partial plan section looking downwardly at the sill of the window opening and showing a shutter panel in opened position.

Referring to FIG. 4, a vertical sealing brush strip 138 is secured by a support 140 to the side of the frame 28 and is disposed in a position to abut against an angle metal strip 142 which forms an abutment member secured to the jamb 14 of the window opening 8. Each jamb 14 is fitted with an abutment member 142 which is engaged by brush 138 in the closed position of panel 20 and by brush support 140 in the opened position of panel 20. When two panels 20 are used as in FIG. 1, their abutting side edges may be fitted with sealing strips (not shown). The sealing brush strips 128, 134, and 38 are designed to seal from the exterior elements a thermally insulating air chamber 144 defined by the panel sheets 30, the window opening 8 and the window unit 16, the chamber 144 being additional to the air chamber 34 incorporated within the shutter panels.

It will be seen that the sealing strips extend around the entire periphery of the window opening 8 in the closed position of panels 20.

It will be also noted that the external disc journals 80 and internal disc journal 88 form a very good seal with the shaft 78 to prevent exterior cold air from entering the building through bore 79.

I claim:

1. An external shutter unit for installation on the outside of an external building wall having an inside and an outside face and a window opening comprising a top track and a bottom track, means to secure said tracks to said building wall in horizontal positions above and below said window opening respectively and outwardly spaced from said wall outside face, a shutter panel having an outside and an inside face, top and bottom guiding roller means carried by said panel at said panel inside face and engageable with the top and bottom side respectively of said top and bottom tracks to support said panel in a vertical plane outwardly spaced from and parallel to said building wall outside face and guide said panel for movement in said plane between opened and closed positions at a side of said window opening and in front thereof respectively, a horizontal rack carried by said panel and inwardly spaced from said panel inside face, a driving shaft of a length to extend through a bore made in said external building wall and protrude from said building wall inside and outside faces, a manually operable crank wheel and a rack meshing pinion to be secured to opposite ends of said driving shaft at said wall inside and outside faces respectively for moving said panel between closed and opened positions, said shutter panel of a size to extend above and below said window opening and conceal said tracks, thermal insulating means carried by said shutter panel, protruding from its inside face and of a size and in a position to register with said window opening in the closed position of said shutter panel, and seal means carried by said panel at its inside face and engageable with said building external wall at its outside face to seal the periphery of said window opening when said panel is in said closed position and to allow movement of said panel from said closed position to said opened position, a first spring suspension means interposed between said panel and said top guiding roller means to upwardly bias said panel against the weight thereof and maintain said bottom guiding roller in rolling and guiding engagement with the bottom side of said bottom track while allowing retrieval of said bottom guide roller means from said bottom track upon downwardly pressing said panel against the bias of said first spring suspension means.

2. An external shutter unit as defined in claim 1, further including a second spring suspension means interposed between said panel and said rack to bias said rack in meshing engagement with said pinion.

3. An external shutter unit for installation on the outside of an external building wall having an inside and an outside face and a window opening and comprising a top track and a bottom track, means to secure said tracks to said building wall in horizontal positions above and below said window opening respectively and outwardly spaced from said wall outside face, a shutter panel having an outside and an inside face, top and bottom guiding roller means carried by said panel at said panel inside face and engageable with the top and bottom side respectively of said top and bottom tracks to support said panel in a vertical plane outwardly spaced from and parallel to said building wall outside face and guide said panel for movement in said plane between opened and closed positions at a side of said window opening and in front thereof respectively, a horizontal rack carried by said panel and inwardly spaced from said panel inside face, a driving shaft of a length to extend through a bore made in said external building wall and protrude from said building wall inside and outside faces, a manually operable crank wheel and a rack meshing pinion to be secured to opposite ends of said driving shaft at said wall inside and outside faces respectively for moving said panel between closed and opened positions, said shutter panel of a size to extend above and below said window opening and conceal said tracks, thermal insulating means carried by said shutter panel, protruding from its inside face and of a size and in a position to register with said window opening in the closed position of said shutter panel, and seal means carried by said panel at its inside face and engageable with said building external wall at its outside face to seal the periphery of said window opening when said panel is in said closed position and to allow movement of said panel from said closed to said opened position, a spring suspension means interposed between said panel and said rack to bias said rack in meshing engagement with said pinion.

4. In combination with an external wall of a building structure having a window opening which is fitted with a window unit, said external wall having an outside and an inside face and a window opening sill protruding from said outside face, a shutter unit having top and bottom, horizontal track means secured to said external wall on the outside thereof with said top track means located above said window opening and said bottom track means located below said sill, a shutter panel supported by said top track means and guided by both said top and bottom track means for movement in a plane parallel to and outwardly spaced from said building wall outside face and outwardly of said sill between an open and a closed position in front of said building wall at a side of said window opening and in front of said window opening respectively, driving means for moving said panel from one to the other of said positions, said driving means include a rack carried by said panel between the latter and said building wall, parallel to said tracks and below said sill and a pinion meshing with said rack, manually operable means located at the inside face of said building wall and accessible in a room of said building structure, adjacent said window opening extending through said building wall and connected to said driving means to actuate the latter, thermal insulation carried by said panel at its inside face in a position to register with said window opening when said panels is in closed position, and seal means to seal the periphery of said window opening between said panel and said external wall when said panel is in closed position, said manually operable means including a shaft extending through a bore of said building external wall, a crank wheel secured to one end of said shaft at said inside face, said pinion secured to the opposite end of said shaft externally of said outside face and seal means surrounding said drive shaft.

5. The combination as defined in claim 4 wherein said seal means include sealing brushes carried by said panel and wherein contact with engagement members carried by said external wall.

* * * * *